US005821463A

United States Patent [19]

Ngo

[11] Patent Number: 5,821,463

[45] Date of Patent: Oct. 13, 1998

[54] MECHANICAL CONNECTOR SPLICE FOR CABLE

[75] Inventor: Hung Viet Ngo, Harrisburg, Pa.

[73] Assignee: The Whitaker Corporation, Wilmington, Del.

[21] Appl. No.: 663,837

[22] Filed: Jun. 14, 1996

[51] Int. Cl.[6] ..... H01R 4/18

[52] U.S. Cl. ..... 174/84 C; 174/92; 439/98

[58] Field of Search ..... 174/84 C, 92; 439/98, 877, 882

[56] References Cited

U.S. PATENT DOCUMENTS

| | | | |
|---|---|---|---|
| 2,166,458 | 7/1939 | Berndt et al. | 174/94 |
| 2,187,230 | 1/1940 | Frank | 287/75 |
| 3,136,844 | 6/1964 | Petersen | 174/90 |
| 3,243,500 | 3/1966 | Rabinowitz | 174/84 |
| 3,515,974 | 6/1970 | Beinhaur et al. | 174/90 |
| 3,681,512 | 8/1972 | Werner et al. | 174/84 R |
| 3,904,814 | 9/1975 | Dawson et al. | 174/84 R |
| 4,029,895 | 6/1977 | Scarborough | 174/138 F |
| 4,057,187 | 11/1977 | Cranston et al. | 228/107 |
| 4,179,583 | 12/1979 | Sergev | 174/21 R |
| 4,252,992 | 2/1981 | Cherry et al. | 174/90 |
| 4,269,465 | 5/1981 | Mueller . | |
| 4,324,949 | 4/1982 | Grandjean | 174/71 R X |
| 4,362,352 | 12/1982 | Hawkins et al. | 339/248 |
| 4,723,920 | 2/1988 | Werner | 439/782 X |
| 4,745,239 | 5/1988 | Conrad | 174/72 R |
| 4,752,252 | 6/1988 | Cherry et al. | 439/784 |
| 4,829,146 | 5/1989 | Duve | 174/94 R |
| 5,035,660 | 7/1991 | Werner | 439/796 X |
| 5,278,353 | 1/1994 | Buchholz et al. | 174/84 R |
| 5,683,273 | 11/1997 | Garver et al. | 439/784 |

FOREIGN PATENT DOCUMENTS

| | | | |
|---|---|---|---|
| 0 470 388 | 2/1992 | European Pat. Off. | F16B 31/02 |
| 1 025 428 A | 4/1953 | France . | |
| 1233106 | 10/1960 | France | 174/92 |
| 0 239 428 | 9/1987 | France | H01R 4/24 |
| 3-93421 | 4/1991 | Japan | 174/92 |
| 1422 935 | 1/1976 | United Kingdom | H01R 9/04 |
| 2 174 851 | 11/1986 | United Kingdom | H01R 4/28 |
| 2 177 857 | 1/1987 | United Kingdom | H01R 11/11 |
| 2 262 396 | 6/1993 | United Kingdom | H01R 4/36 |
| 2 266 628 | 11/1993 | United Kingdom | H01R 43/00 |
| 2 272 586 | 5/1994 | United Kingdom | H01R 4/36 |

OTHER PUBLICATIONS

International Search Report, Applicant's Reference 16634 PCT, International Application No. PCT/US 97/11055, International Filing Date, Jun. 24, 1997.

Patent Application Serial No. 08/587,117, DuPont, Filed Jan. 11, 1996. Abstract and drawings only.

Patent Application Serial No. 08/312,579 Cherry et al., Filed Sep. 27, 1994. Abstract and drawings only.

*Primary Examiner*—Bot L. Ledynh

*Assistant Examiner*—Chau N. Nguyen

[57] ABSTRACT

The invention is directed to an electrical connector having a main body with a conductor receiving passageway extending therethrough. The conductor receiving passageway has a conductor gripping surface with an upper level and a lower level for engaging a conductor. A pair of gripping jaws are moveable to secure a conductor within the conductor receiving passageway, there being a longer gripping jaw corresponding to the lower level and a shorter gripping jaw corresponding to the upper level. The conductor is secured within the conductor receiving passageway between the longer gripping jaw and the lower surface and also between the shorter gripping jaw and the upper surface.

8 Claims, 3 Drawing Sheets

MECHANICAL CONNECTOR SPLICE FOR CABLE

FIELD OF THE INVENTION

The present invention is directed to a mechanical connector for splicing a pair of cables of the type used in electrical utility style overhead distribution and transmission systems.

BACKGROUND OF THE INVENTION

Overhead distribution of electrical cables typically are a part of the distribution portion of the power network. The cables are designated AAC, AAAC, or ACSR which stand for all aluminum conductor, all aluminum alloy conductor, or aluminum conductor steel reinforced, respectively; or they may be copper where cable diameters are in the range of three quarters to one inch. Transmission cables are typically stranded aluminum conductors about a steel reinforcing core (ACSR) having a diameter from three quarters of an inch and up.

There are a number of patents directed to splicing transmission type cable where the inventions rely upon devices which are activated in the same direction as the cable and have cable gripping jaws which grip on the cable in the direction of the tension of the cable. Many of these inventions are terminated by using internally fired or explosively activated devices or, alternatively, tool activated devices, or spring activated devices where either the explosive force, the tool activation, or the spring pushes a set of jaws outwardly thereby having them clamp down and around the cables to be connected U.S. Pat. No. 3,515,794 shows such an electrical connector which is tool activated. The connector has a hollow shell with a tapered internal surface. Along the internal surface of the hollow shell are a plurality of conductor gripping jaws which are compressible on the conductor at spaced locations along the internal surface. The connector is applied by use of a tool which forces the jaws of the connector along the tapered internal surface to compress the gripping jaws on the conductor.

In order to maintain a good electrical and mechanical grip on the conductors, it is necessary to provide tension along the conductors to keep the gripping jaws on the conductor at a location where they provide a good grasp on the conductor. In order to maintain this tension, it is necessary that both conductors are terminated within the electrical connector at the same time thereby ensuring that the force from the gripping jaws is maintained on the conductors.

In order to allow good electrical flow, contact interfaces must be obtained between several components of the connector, between the conductor and the gripping members, between the gripping members and the hollow shell, from the hollow shell to the other half of the connector and its components.

What is needed is an electrical connector that will provide a good gripping force on the conductors but will be able to be terminated to only one conductor at a time and still provide a good gripping action. What is also needed is an electrical connector with fewer contact interfaces to ensure low impedance to the electrical flow.

SUMMARY OF THE INVENTION

The invention comprises an electrical connector having a main body with a conductor receiving passageway extending therethrough. The conductor receiving passageway has a conductor gripping surface with an upper level and a lower level for engaging a conductor. A pair of gripping jaws are moveable to secure a conductor within the conductor receiving passageway, there being a longer gripping jaw corresponding to the lower level and a shorter gripping jaw corresponding to the upper level. The conductor is secured within the conductor receiving passageway between the longer gripping jaw and the lower surface and also between the shorter gripping jaw and the upper surface.

BRIEF DESCRIPTION OF THE DRAWINGS

Embodiments of the present invention will now be described with reference to the accompanying drawings, in which.

DETAILED DESCRIPTION OF THE INVENTION

Figure 1:
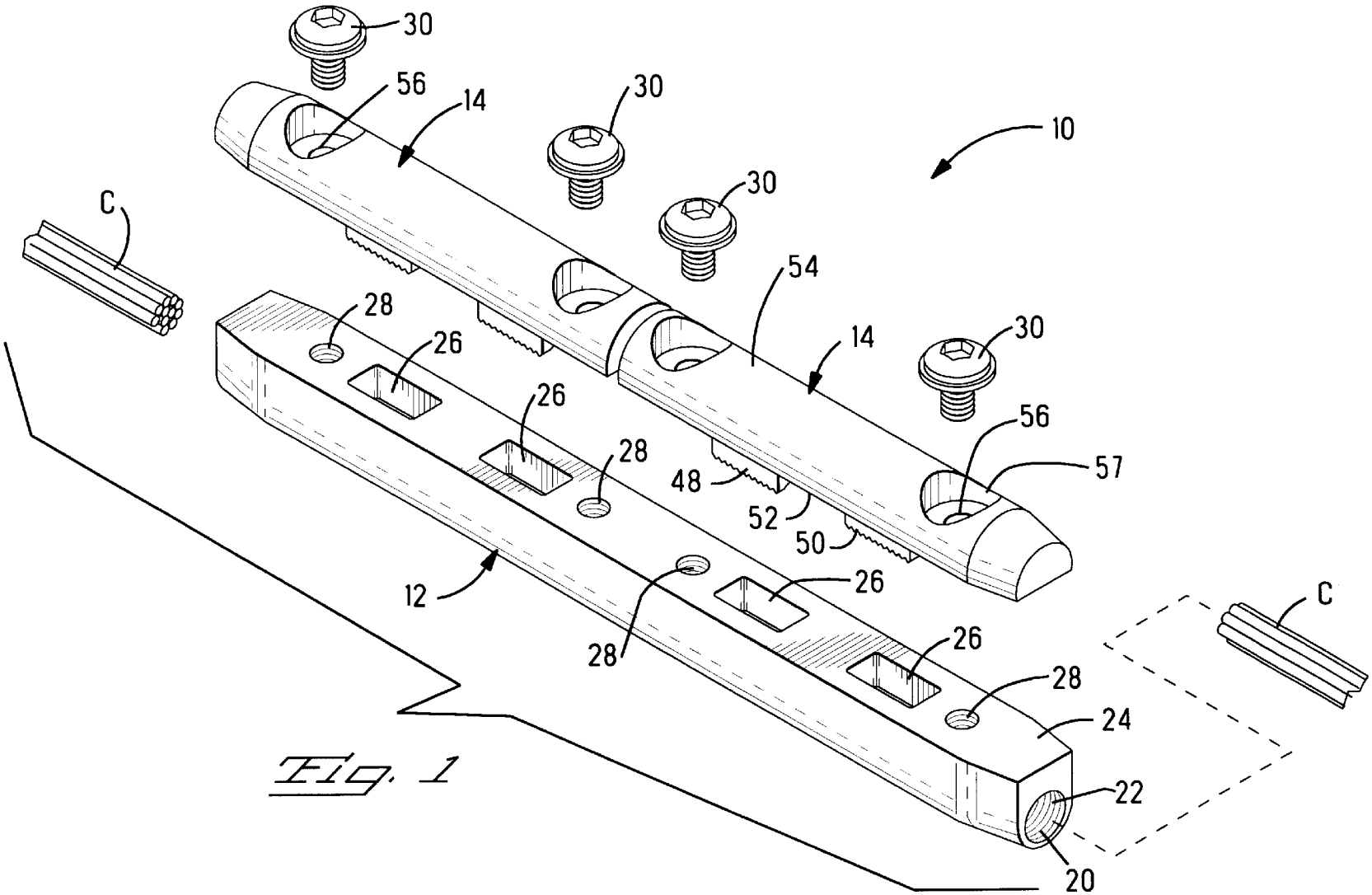
FIG. 1 is an isometric view of the electrical connector of the current invention showing the gripping jaws exploded away from the housing.

FIG. 1 shows an exploded view of the electrical connector 10 of the present invention. The electrical connector 10 includes a main housing 12 and two gripping members 14. The main housing 12 is preferably made from an electrically conductive material such as aluminum, copper or alloys thereof. The main housing 12 receives the electrical conductors C therein. The gripping members 14 are received on the main housing 12 and are used to secure the conductor therein. The gripping members 14 can be made from an electrically conductive material, or it can alternatively be made from some other material with enough strength to engage the conductors C and prevent pull outs from the connector 10.

The main housing 12 has a conductor receiving passageway 20 which extends through the main housing from one end to the other and has two openings 22 disposed at either end of the passageway 20. The openings 22 are shown in FIG. 1 as uncovered openings, however, it is possible that a cap or some other type of insertion member can be received within the openings 22 to provide both protection for the interior of the main housing and the conductor receiving passageway. It is also possible to provide an insertion assistant device for assisting in guiding the conductor C into the conductor receiving passageway 20.

Figure 2:
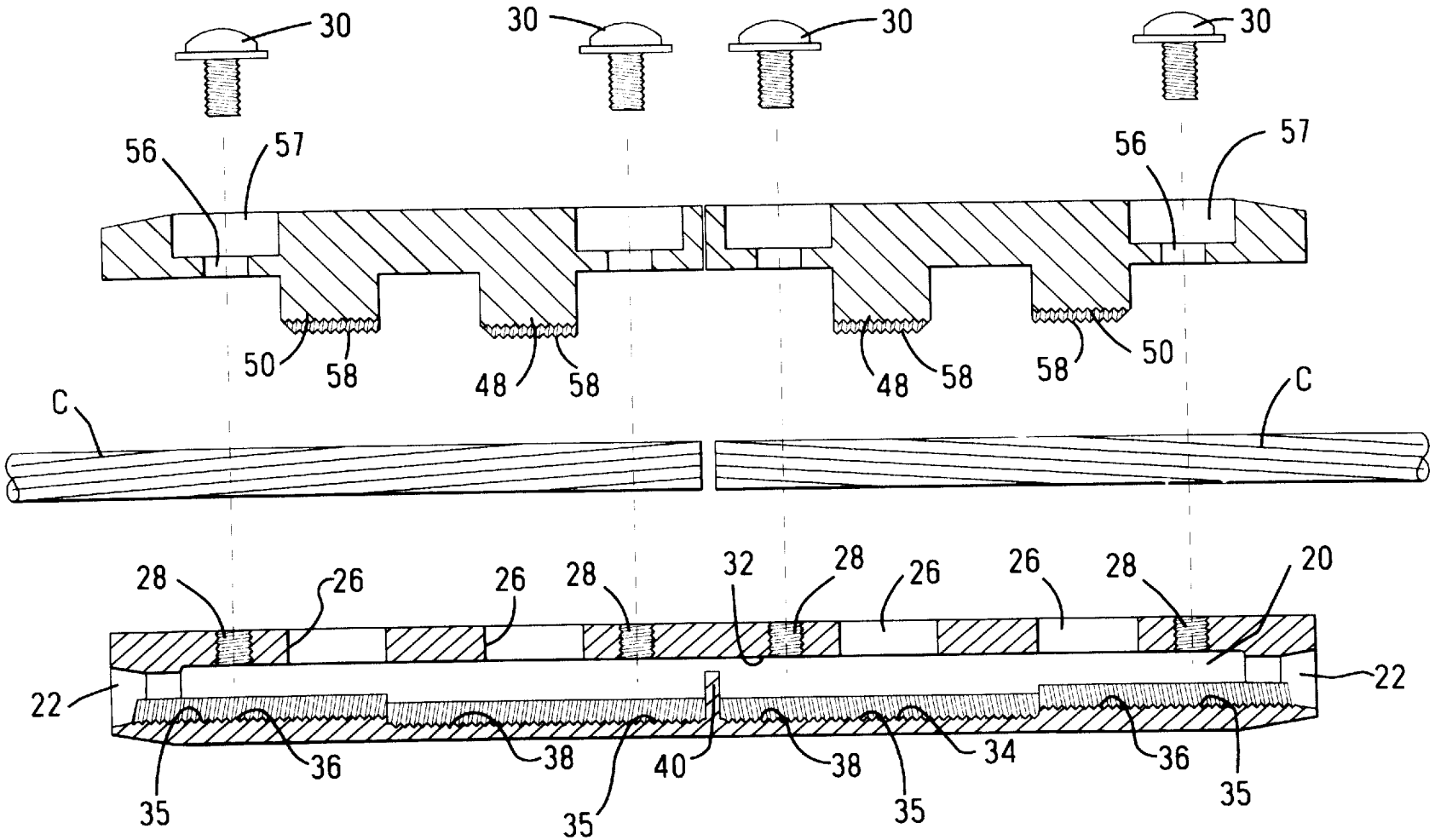
FIG. 2 is an exploded cross sectional view of the electrical connector of the present invention.

The main housing 12 has a flat top 24 extending along the entire length of the main housing 12. Extending from the flat top into the interior of the main housing 12 are jaw openings 26. The embodiment as shown in FIG. 1 has four jaw openings received along the flat top 24. The jaw openings 26 extend from the flat top 24 through to the conductor receiving passageway 20 as is shown in FIG. 2. There are also four screw holes 28 received along the flat top 24. The screw holes are shown in FIG. 2 as being received completely through from the flat top 24 to the conductor receiving passageway 20, however, it is not necessary that they extend completely through to the conductor receiving passageway. It is only necessary that the screw holes 28 extend sufficiently far enough into the main housing 12 so that screws 30 can be received therein to secure the gripping members 14 to the main housing 12.

The conductor receiving passageway 20 has a top 32 and a bottom surface 34. The bottom surface 34 is shown having a rough surface 35 such as a threaded surface. Alternatively, the rough surface could be just parallel serrations, grooves, or a rough textured surface providing an interface that will provide a sufficient contact with the conductor C. Preferably, the threaded surface will have grooves that run perpendicular to the direction of the conductor C to provide better gripping action on the conductor.

Along the center of the conductor receiving passageway 20 is a separating wall 40 which separates the passageway into individual halves for receiving the different conductors C. Along each one of the halves of the conductor receiving passageway 20 there are two separate conductor receiving levels 36,38. Conductor receiving level 36 is closer to the opening 22 and is positioned higher than the conductor receiving level 38. The importance of this feature will be described more fully hereinafter.

Each of the gripping members 14 have two gripping jaws 48,50 which extend from a bottom surface of the gripping member. The gripping member 14 also has a top rounded surface 54 with two screw receiving holes 56. The screw receiving holes 56 are surrounded by recesses 57 which are set back from the top rounded surface 54. The recesses 57 are designed to receive the screw head therein so that the screw head is not protruding along the top surface of the gripping member 14. The screw holes 56 are non-threaded holes and are designed to receive the threaded portion of the screw therethrough without threadingly engaging the screw hole. The screw head abuts against a bottom wall of the recess when the gripping member 14 is secured to the main housing 12.

Each of the gripping jaws 48,50 also have a serrated section 58. The serrated section as with the earlier described serrated section can either be a machine screw section or, alternatively, parallel serrations, grooves, or a rough textured surface to provide an interface sufficient to grip on the conductor C and provide a good electrical and mechanical connection therebetween.

Figure 3:
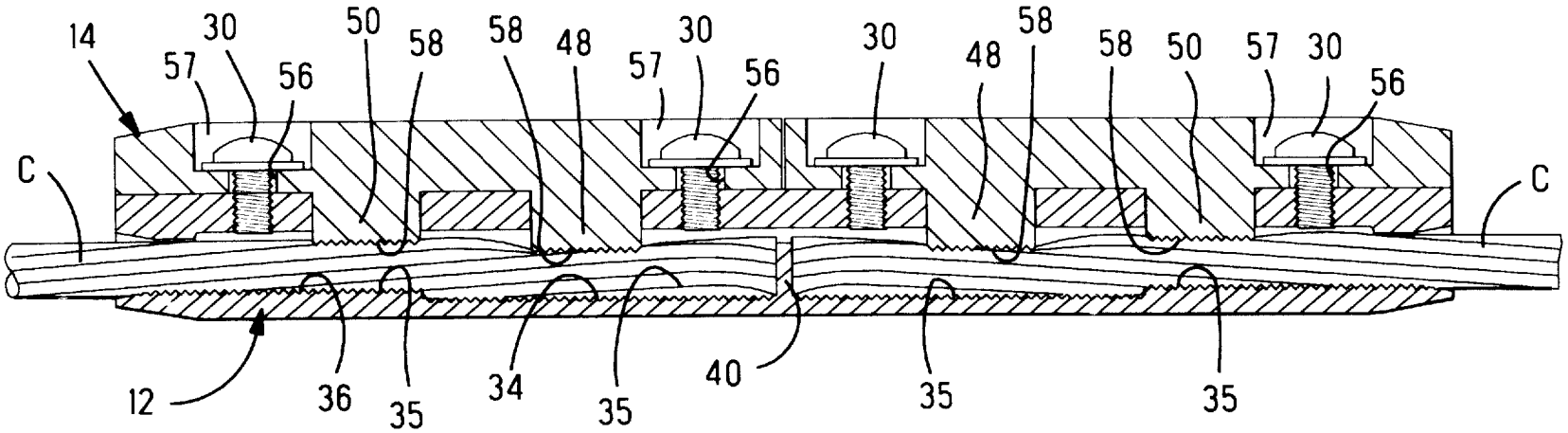
FIG. 3 is a cross sectional view of the electrical connector of the present invention showing the conductors spliced and terminated to the electrical connector.

FIG. 3 shows the assembled electrical connector on the conductors C. The conductors C are received within the conductor receiving passageway 20, each extending from one of the respective openings 22. The conductor C is received within the connector receiving opening 20 until the end of the conductor abuts against the separating wall 40 thereby ensuring that the conductor is received far enough within the conductor receiving passageway to get proper termination with the gripping jaws 48,50. FIG. 3 shows two conductors C received within the electrical connector, however, it is not necessary that both be terminated at the same time. One of the conductors C can be terminated without it being necessary to terminate the other conductor.

Once the conductor C is received within the connector receiving passageway, the crimping member 14 is secured to the top of the main housing 12 by inserting the screws 30 through the screw receiving holes 56 and into the screw holes 28. The screws threadably engage the screw holes 28 to secure the gripping member 14 to a main housing 12. The screws can be of the locking type wherein one section preferably a middle section of the screw, is thicker than the beginning section of the screw, so that as the screw is being secured within the screw hole 28, it will engage the screw hole 28 more snugly and thereby preventing the screw from backing out due to vibration or other means.

When the gripping member 14 is being secured to the main housing, the gripping jaws 48,50 are pushed through the openings 26 and into the conductor receiving passageway 20. The serrated sections 58 on the gripping jaws 48,50 are received against the conductor C and as the screw is turned, the head of the screw engages the recess 57 causing the gripping member to be pushed down against the conductor and forces the serrated section to bite into the surface of the conductor thereby forming a good electrical and mechanical connection therebetween. Also, because of the force, the serrated section along the bottom surface 34 of the conductor receiving passageway will bite into the surface of the conductor C thereby forming a good electrical and mechanical connection therebetween.

The good gripping action is obtained by the different conductor receiving levels 36,38 within the conductor receiving passageway working in conjunction with the different size gripping jaws 48,50. The longer gripping jaw 48 corresponds with the lower conductor receiving level 38 whereby the conductor C is pushed further down in this area because the conductor is pushed into different levels through the conductor receiving passageway. In the section between the gripping jaws 48,50 the conductor C will get squeezed more into the area between the two gripping jaws 48,50. The conductor will be deformed this way because the creep of the aluminum of the conductor. When the aluminum is placed under pressure, it will tend to flare or flow out of the area of pressure. Therefore, material from the conductor will flow into the area between the gripping jaws. Because conductor C is being deformed in this way such that it is squeezed into this area, it makes it more difficult for the conductor to be pulled back out of the electrical connection connector. The deformed material of the conductor will engage against the higher level 36 and against the gripping jaw 50 to prevent the conductor from being pulled out laterally from the terminated connector.

Both of the conductors C are pushed against the serrated section along the bottom surface 34 of the conductor receiving passageway thereby providing good electrical connection from the conductors C to the main housing 12. Therefore, there are only the contact interfaces between the two conductors C and the main body which must be made in order to ensure good electrical flow and only one member external to the conductors through which electricity must flow.

The embodiment presented in the drawings is shown with symmetrical halves to the electrical connector to receive conductors of approximately the same diameter. It is also possible that the electrical connector can be designed to receive different sized conductors. In order to do this, it would be necessary to design the halves so that one side is smaller or larger than the other to accommodate the different sizes.

The advantages of the present invention are that there is only one surface which must be formed between the electrical conductor C and the connector to provide a good electrical connection therebetween. Further, the use of gripping jaws at different levels provides a good mechanical connection to the conductor C preventing pull out of the conductor.

The electrical connector of the present invention and many of its attendant advantages will be understood from the foregoing description. It is apparent that various changes may be made in the form, construction, and arrangement of parts thereof without departing from the spirit or scope of the invention or sacrificing all of its material advantages.

What is claimed is:

1. An electrical connector, comprising:

a main body having a conductor receiving passageway extending therethrough, the conductor receiving passageway having a conductor gripping surface therealong, the conductor gripping surface having an upper level and a lower level for engaging at least one conductor; and a pair of gripping jaws moveable to secure said conductor within the conductor receiving passageway, there being a longer gripping jaw corresponding to the lower level and a shorter gripping jaw corresponding to the upper level;

whereby the conductor is secured within the conductor receiving passageway between the longer gripping jaw and the lower surface and also between the shorter gripping jaw and the upper surface.

2. The electrical connector of claim 1, wherein a gripper member has the gripping jaws thereon, the gripper member being movably mounted to the main body to move the gripping jaws into and out of engagement with the conductor.

3. The electrical connector of claim 1, wherein the gripping jaws having a serrated surface thereon to grippingly engage the conductor.

4. The electrical connector of claim 2, wherein the conductor gripping surface has a serrated surface for grippingly engaging the conductor.

5. The electrical connector of claim 1, wherein the main body has two ends with the conductor receiving passageway extending therebetween, there being a separating wall disposed within the passageway to separate the passageway into two halves for receiving two of the conductors.

6. The electrical connector of claim 5, wherein the lower level is adjacent the separating wall and the upper level is adjacent one of the ends.

7. The electrical connector of claim 2, wherein the gripper member is secured to the main body by a screw and the gripping jaws are moved into and out of engagement with the conductor by actuating the screw.

8. The electrical connector of claim 7, wherein the main body has a pair of jaw openings extending along a top surface thereof, the jaw openings being in communication with the conductor receiving passageway, the gripping jaws being received through the jaw openings into the conductor receiving passageway.

* * * * *